United States Patent [19]

Risner

[11] Patent Number: 4,490,677

[45] Date of Patent: Dec. 25, 1984

[54] IGNITION COIL TESTING MEANS

[76] Inventor: Joseph Risner, 245 Delaware Ave., Oakhurst, N.J. 07755

[21] Appl. No.: 429,858

[22] Filed: Sep. 30, 1982

[51] Int. Cl.[3] ..... F02P 17/00

[52] U.S. Cl. ..... 324/388; 324/400; 324/402

[58] Field of Search ..... 324/388, 400, 402, 385

[56] References Cited

U.S. PATENT DOCUMENTS

| | | | |
|---|---|---|---|
| 1,846,153 | 2/1932 | Sherman | 324/385 |
| 1,955,394 | 4/1934 | Stromberg | 324/388 X |
| 2,076,618 | 4/1937 | Cooper | 324/388 |
| 2,254,080 | 8/1941 | McCarty | 324/388 X |
| 3,906,917 | 9/1975 | Lorti | 324/385 X |
| 3,959,725 | 5/1976 | Capek | 324/388 X |
| 4,101,859 | 7/1978 | Reeves et al. | 324/402 X |

*Primary Examiner*—Stanley T. Krawczewicz
*Attorney, Agent, or Firm*—Bernard J. Murphy

[57] ABSTRACT

According to the preferred embodiment illustrated herein, the invention comprises a platform of insulating material to which a spring clip is fixed, in order that the platform can be slidably secured to the upstanding side wall of an ignition distributor cap, such cap having an integral ignition coil and an exposed coil terminal. Fixed to the platform, and projecting therefrom for a contacting engagement thereof with the coil terminal, is a flexible, electrical conductor or contactor. A spark plug, also mounted replaceably onto the platform, has the central, metallic terminal thereof in contacting engagement with the flexible contactor through a limb to which the contactor is replaceably secured. The limb is metallic, and electrical continuity is made therethrough from the central spark plug terminal to the flexible contactor. The latter projects from the platform in a normal attitude relative thereto with a reach into the center of the distributor cap whereat the coil terminal is sited. The platform provides for a grounding of the shell of the spark plug. The latter is held in an apertured, metallic bracket which is secured to the platform and which has a terminal for a grounding lead.

11 Claims, 3 Drawing Figures

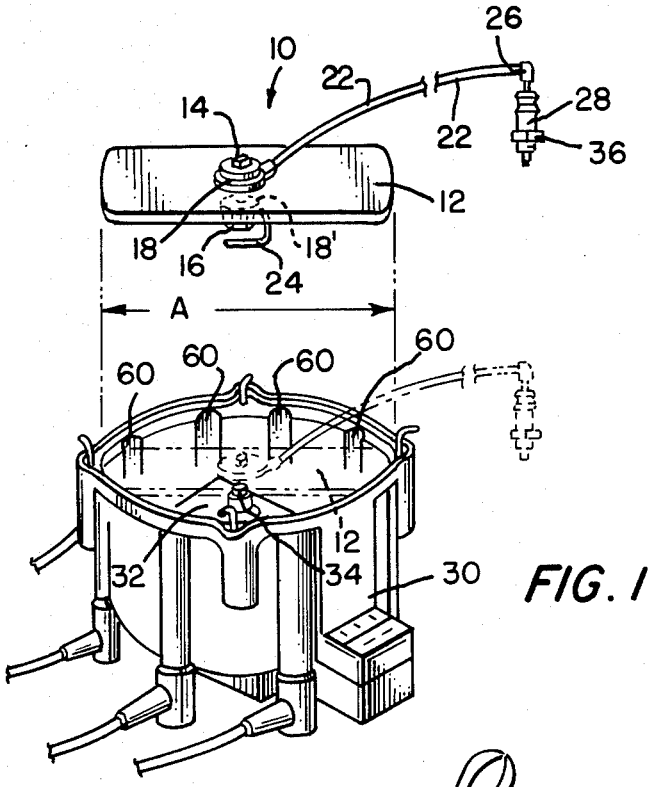
FIG. 1
FIG. 2
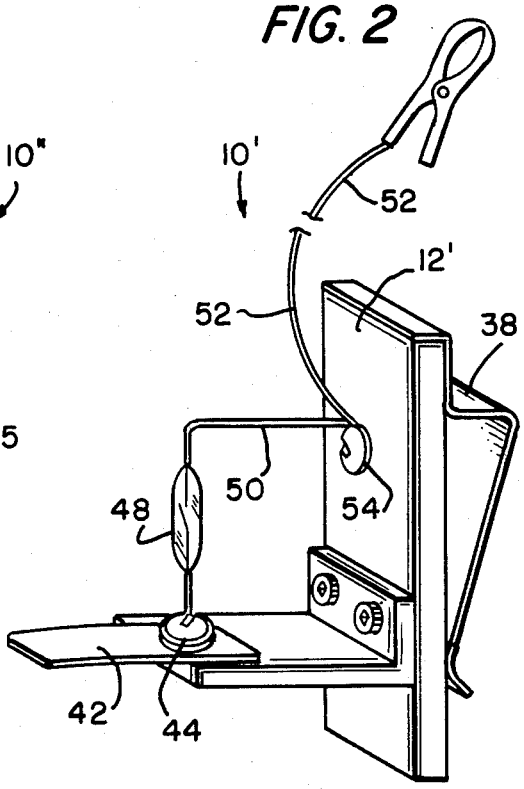
FIG. 3
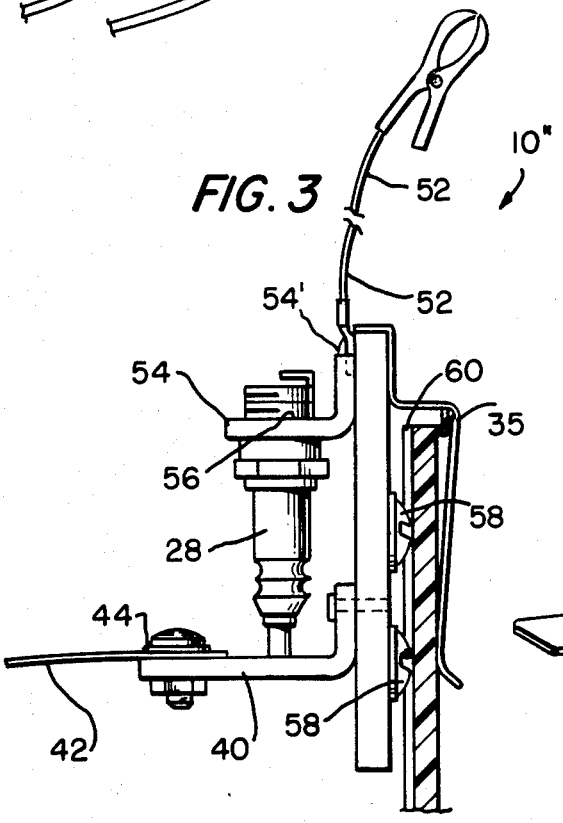

IGNITION COIL TESTING MEANS

This invention pertains to electrical testing devices, and in particular to means for testing an ignition coil for ignition power.

It is already known in the technology to test ignition coils by holding the coil high-voltage cable in near adjacency to an electrical ground, and cranking the spark-ignition engine involved to ascertain whether a spark will jump between the ground and the cable termination. In a great number of modern automobiles, manufactured by a prominent American firm, such aforesaid test practice is not possible. Such automobiles employ an ignition distributor having a removable cap in which the ignition coil, and its high voltage contact, is integrally confined. Within, and centrally of the cap, is exposed only a small high-voltage contact or terminal for the ignition coil. Now, to facilitate testing of such integral ignition coils, the manufacturer of these particular automobiles advises the use of a booted spark plug.

According to the manufacturer's instructions, a rubber boot or sleeve is to be fitted over the porcelain-insulation end of a spark plug—an extra, test spark plug—and the boot or sleeve trimmed until it extends but seven sixteenths of an inch (eleven millimeters) from the tip of the central terminal of the test spark plug. Then the metal shell of the spark plug is to be grounded. Next, the trimmed, extending end of the boot or sleeve is slidably fitted onto a round, apertured boss, in the center of the distributor cap, through which the ignition coil terminal extends. Then the engine is to be cranked to ascertain a sparking of the test plug.

This procedure, and test and modified spark plug arrangement, is most unsuitable, for several reasons. It presupposes that the distributor cap can be readily and wholly removed, and access to the central, ignition coil terminal is easily made. On the contrary, as the test must be performed with the six or eight ignition/spark plug wires remaining intact with the cap, and due to the notoriously crowded condition of modern engines, automobile engines, a mechanic or technician is most fortunate if he can access even a portion of a side of the distributor cap. More often than not, he cannot make contact with an obscured and obstructed ignition coil terminal in the center of the cap.

The boot or sleeve must be carefully trimmed as, if it is trimmed too close, the booted or sleeved test, spark plug falls from the apertured boss which it is supposed to engage. If the boot or sleeve is trimmed too long, the tip of the test spark plug, instead of making sure contact with the distributor coil terminal, will be slightly spaced therefrom and define therewith an additional unwanted spark gap. Now, the boot or sleeve can be trimmed slightly longer than it ought to be and pushed onto the apertured boss, forcefully, until a sure contact is made. As the boot or sleeve is rubber, however, it relaxes and moves the spark plug terminal away from the coil terminal. As a practical matter, the mechanic or technician has to hold the booted spark plug forceably in contact with the coil terminal. This has to be done if, as noted, it can be accessed at all.

These automobiles with the ignition coil integral with the distributor cap are known in the trade as HEI (High Efficiency Ignition) systems which use solid-state elements. Now, if the booted spark plug defines a spark gap with the coil terminal, as aforesaid, in addition to the spark gap of the test plug itself, the results can be most unfortunate. Under such circumstances, with subsequent cranking of the engine, and with the occurrence of two, high-voltage sparks, the solid-state circuitry may become damaged. An even more damaging condition can occur if the unreliable, booted spark plug arrangement, previously mentioned, falls off the apertured boss during testing or cranking of the engine. Under this condition, the ignition coil would be working without a load, resulting in extremely high, internal, peak voltages in the secondary winding thereof, subsequently contributing to the ultimate destruction of the coil and its associated electronics.

It is an object to set forth a more facile and secure means for testing ignition coils of the aforesaid type as a purpose of this disclosure. Particularly, it is an object of this invention to set forth, for use with an ignition distributor which has a removable cap with an integral ignition coil and an internally exposed ignition coil terminal, means for testing said coil for ignition power, comprising first means for making electrical contact with the ignition coil terminal in the removable cap; and second means comprising a pair of electrical conductors defining a spark gap therebetween; wherein one electrical conductor of said pair is in electrically-conductive connection with said first means; and third means (1) for engaging a peripheral surface of said cap, and (2) for mounting at least one of said first and second means thereto.

It is also an object of this invention to disclose, for use with an ignition distributor which has a removable cap with an integral ignition coil and an exposed ignition coil terminal, means for testing said coil for ignition power, comprising means defining a spark gap; said spark gap-defining means comprising an element having a pair of electrical conductors in spaced-apart disposition with insulation therebetween; wherein one of said conductors comprises means for making electrical contact with the ignition coil terminal; the other of said conductors of said pair comprises means for effecting an electrical ground; and a platform mounting said spark gap-defining means thereon; wherein said platform is formed of electrically-insulated material; and further including means coupled to said platform for securing said platform in fast, slidable engagement with a peripheral surface of said cap.

Further objects of this invention, as well as the novel features thereof, will become more apparent by reference to the following description, taken in conjunction with the accompanying figures, in which:

FIG. 1 is a perspective illustration of an ignition distributor cap having an integral ignition coil and an exposed ignition coil terminal, with an embodiment of the invention shown in full-line illustration above the cap, and in phantom outline in place within the distributor cap;

FIG. 2 is a perspective illustration of an alternative embodiment of the invention; and FIG. 3 is a side elevation of yet a further, preferred embodiment of the invention.

As shown in FIG. 1, a first embodiment 10 of the novel ignition coil testing means comprises an elongated platform 12 of insulated or non-electrically-conducting material having a prescribed, greatest length "A". Centrally thereof, the platform 12 is bored through and has secured thereat a bolt 14 and nut 16. The bolt head has a washer 18 thereunder as well as an apertured terminal 20 of a high-voltage cable 22. The bolt 14 passes through another washer 18' below the platform 12 which, with nut 16, fastens a U-shaped spring contactor 24 in place. The opposite end of the cable 22 has a spark plug connector 26 coupled thereto, and the tip or central terminal of a spark plug 28 is engaged with the connector.

An ignition distributor cap 30 having an integral ignition coil 32 and an exposed ignition coil terminal 34 is shown below the full-line illustration of the platform 12. The nominal diameter of the inside of the cap 30 corresponds with the length "A" of the platform. Accordingly, upon the platform being forced into the cap 30, it defines a frictional, interference-fit with the upstanding wall of the cap. In phantom, the platform 12 is shown fitted into the cap 30 and, as will be appreciated, the spring contactor 24, therefore, is held in contacting engagement with the ignition coil terminal 34. According to this arrangement, then, it remains only to ground the metal shell 36 of the spark plug 28 to complete a test circuit. Such grounding, of course, may be done with an alligator clip, attached to a ground lead, the clip being fixed to the spark plug shell, and the ground lead fastened to a grounded, metal component. Upon the engine, to which the distributor is coupled, being cranked, the spark plug 28 will evidence an expected sparking, or not, depending upon the condition of the coil and ignition system components.

Embodiment 10 is quite simple of structure, and requires no manual holding in place to perform its function. It does require, however, access to the center of the distributor cap 30. The alternative embodiment 10' of FIG. 2, however, is usable where only a portion of a side of the cap can be accessed.

Embodiment 10' comprises a similar platform 12' which has a spring clip 38 fixed thereto. The latter is provided for slidably engaging a portion of the upstanding wall of the distributor cap 30. The platform 12' mounts a bracket 40 to which is fixed a flexible, metal contactor 42. The contactor 42 is secured to the bracket 40 by means of hardware 44 which also secures one lead 46 of a spark-gap element 48. The opposite lead 50 of the element 48 is held fast to the platform 12', in common with an end of a grounding cable 52. by further hardware 54.

This embodiment 10', then, is simply slidably engaged with a portion of the side wall of the distributor cap 30, to cause the flexible contactor 42 to come into electrically-contacting engagement with the coil terminal 34. The reach of the bracket 40 and contactor 42 being predetermined to insure a full engagement of the latter with the terminal 34. Clearly, then, if it is not possible to remove the cap 30 to a positioning in which all thereof is unobstructed, it is sufficient to have access to only a portion of the side wall thereof to use the embodiment 10' of the invention.

The embodiment 10'' of FIG. 3 is similar in most respects to that of embodiment 10' of FIG. 2, except that it is of more sturdy construction. It has a similar platform 12'' and bracket 40 and contactor 42. In addition, however, it carries a metal limb 54. Limb 54 has a central aperture 56 which receives the shell end of a spark plug 36'. The aperture 56 is threaded, in order that the plug 36' can be tightened therein. The terminal tip of the opposite end of the spark plug 36' is in contacting engagement with the metal bracket 40. Platform 12'' has a same clip 38 therebehind to engage the side wall of the cap. In addition, the platform 12'' has hemispheric keys 58 fixed on the rear thereof. The typical HEI distributor cap 30 has a plurality of arcuate recesses 60 formed therein, and extending axially along the inside surface of the cap. Such recesses 60 slidably receive the keys 58 to give the slidably mounted embodiment 10'' a positive, straight orientation on the wall of the cap 30. Patently, any of the plurality of recesses may be selected for the slidable engagement of the embodiment 10''. The limb 54 is held to the platform 12'' by means of hardware 54', and the latter is used also to fix thereto the terminal end of a same grounding cable 52.

The invention discloses most expedient and simple structures for simply and with easy facility testing a distributor coil 32 which is integral with the cap 30, the relative inaccessability of the cap notwithstanding. As pointed out, particularly with reference to embodiments 10' and 10'', only a very limited access to a side of the wall of the cap 30 is necessary, and the novel testing means can be fixed to the cap wall in any of a number of locations thereabout. All embodiments of the invention are self-supporting in the distributor cap; there is no need for manual pressure to be applied thereto to keep the contactors 24 or 42 in positive engagement with the coil terminal 34. Use of the invention avoids the risk of damage to solid-state components of an ignition system, as all electrical connections are sure and positive.

While I have described my invention in connection with specific embodiments thereof, it is to be clearly understood that this is done only by way of example, and not as a limitation to the scope of my invention, as set forth in the objects thereof and in the appended claims.

I claim:

1. For use with an ignition distributor which has a removable cap with an integral ignition coil and an exposed ignition coil terminal, means for testing said coil for ignition power, comprising:

first means for making electrical contact with the ignition coil terminal in the removable cap; and second means comprising a pair of electrical conductors defining a spark gap therebetween; wherein one electrical conductor of said pair is in electrically-conductive connection with said first means; and third means (1) for engaging a peripheral surface of said cap, and (2) for mounting at least one of said first and second means thereto.

2. Ignition coil testing means, according to claim 1, wherein:

said third means comprises a platform having a given longitudinal dimension corresponding to an inside diameter of said cap, whereby said platform effects a frictional, interference fit with said cap.

3. Ignition coil testing means, according to claim 1, wherein:

the other electrical conductor of said pair thereof defines a grounding element.

4. Ignition coil testing means, according to claim 1, wherein:

said second means comprises a spark plug.

5. Ignition coil testing means, according to claim 1, wherein:

said third means comprises means for slidably clasping an upstanding side of said cap.

6. Ignition coil testing means, according to claim 5, wherein:

said third means further comprises an electrically-insulated platform, and a resilient clip, the latter defining said clasping means; and said second means comprises a spark plug replaceably secured to said platform.

7. Ignition coil testing means, according to claim 6, wherein:

said first means comprises an electrically-conductive element mounted on, and projecting from said platform in an attitude substantially normal to said platform.

8. Ignition coil testing means, according to claim 7, wherein:

said element is resilient.

9. Ignition coil testing means, according to claim 6, wherein:

said platform has an apertured bracket secured thereto;

said bracket is electrically-conductive;

said spark plug has its metallic shell thereof secured in said apertured bracket in electrically-conductive contact therewith; and said bracket has means for attaching thereto an electrical ground lead.

10. Ignition coil testing means, according to claim 9, wherein:

said platform further has a limb secured thereto, and extending therefrom in an attitude substantially normal to said platform;

said limb is electrically-conductive;

said first means comprises an electrically-conductive element fastened to and projecting from said limb; and said spark plug has its center, metallic terminal in contacting engagement with said limb.

11. For use with an ignition distributor which has a removable cap with an integral ignition coil and an exposed ignition coil terminal, means for testing said coil for ignition power, comprising:

means defining a spark gap;

said spark gap-defining means comprising an element having a pair of electrical conductors in spaced-apart disposition with insulation therebetween;

wherein:

one of said conductors comprises means for making electrical contact with the ignition coil terminal;

the other of said conductors of said pair comprises means for effecting an electrical ground; and a platform mounting said spark gap-defining means thereon; wherein said platform is formed of electrically-insulated material; and further including means coupled to said platform for securing said platform in fast, slidable engagement with a peripheral surface of said cap.

* * * * *